US007413156B1

(12) United States Patent
Cho

(10) Patent No.: US 7,413,156 B1
(45) Date of Patent: Aug. 19, 2008

(54) HANGER BAR FOR FIXTURE AND METHOD

(75) Inventor: Woo Hyun (John) Cho, Seoul (KR)

(73) Assignee: Ilsung Moolsan Co., Ltd., Seoul (KR)

( * ) Notice: Subject to any disclaimer, the term of this patent is extended or adjusted under 35 U.S.C. 154(b) by 346 days.

(21) Appl. No.: 11/115,737

(22) Filed: Apr. 26, 2005

(51) Int. Cl.
*B42F 13/00* (2006.01)
*E04G 25/00* (2006.01)

(52) U.S. Cl. ..... 248/343; 248/200.1; 248/340; 362/147; 362/368

(58) Field of Classification Search ..... 248/200.1, 248/200, 264, 265, 317, 340, 344, 475.1, 248/493, 343; 362/265–366, 368, 370–372, 362/147–148; 211/182, 204, 192, 113
See application file for complete search history.

(56) References Cited

U.S. PATENT DOCUMENTS 2,316,389 A * 4/1943 Atkinson ..... 248/300
4,471,416 A * 9/1984 Druffel ..... 362/430
4,658,679 A * 4/1987 Nitzberg et al. ..... 81/23
5,222,800 A * 6/1993 Chan et al. ..... 362/147
5,505,419 A * 4/1996 Gabrius ..... 248/343
6,272,794 B1 * 8/2001 Rippel et al. ..... 52/27
6,629,680 B2 * 10/2003 Weck et al. ..... 248/475.1
6,632,006 B1 * 10/2003 Rippel et al. ..... 362/366
7,040,586 B2 * 5/2006 Kusber et al. ..... 248/200.1
2005/0247842 A1 * 11/2005 Wronski ..... 248/323
2007/0075206 A1 * 4/2007 Wright et al. ..... 248/343

* cited by examiner

*Primary Examiner*—Brian Glessner
*Assistant Examiner*—Tan Le
(74) *Attorney, Agent, or Firm*—Kenneth E. Darnell

(57) ABSTRACT

A hanger bar attachable between joists for supporting a fixture has an attaching plate at distal ends with a contact portion for bearing against a joist and a laterally extending portion that defines a recess. The extended portion defines an elongate slot that receives a bushing and a fastener extends through the bushing for securing the elongate bar to the joist. The hanger bar is selectively positionable after initial attachment to the joist by moving the attaching plate as guided by the bushing in the slot. A method of attaching a hanger bar to joists for supporting fixtures is disclosed.

30 Claims, 3 Drawing Sheets

HANGER BAR FOR FIXTURE AND METHOD

TECHNICAL FIELD

The present invention relates to devices to mount fixtures to supports. More particularly, the present invention relates to apparatus and methods for installing a hanger bar between joists of a ceiling for supporting recessed lighting and other fixtures.

BACKGROUND OF THE INVENTION

Lighting provides illuminative and ornamental effects for interior and exterior design for homes, offices and other buildings. A wide range of lighting fixtures are available including sconce fixtures that mount to walls, ceiling mounted housings that support shades, track lighting, recessed lighting fixtures, and other types.

Recessed lighting fixtures are particularly ornamentally attractive by providing a lighting effect but with minimal fixture presence within a room. The housing installs interior to a ceiling space and typically provides an illuminative effect for the space below the ceiling with minimal external protrusion from the fixture, such as a trim ring or the like.

While the use of recessed lighting fixtures has been accepted, installation provides problems. The recessed lighting fixture is typically installed during initial construction activities (although after-construction retro-fit recessed lighting fixtures have been provided). The joist area for the ceiling is open and accessible because the ceiling surface is yet to be installed. Typical installations use nails that pass through openings in flanges at opposing ends of a hanger bar. If the installer initially places the flange too high or too low relative to the bottom of the joist, the nail needs to be pulled out for reinstallation. A fully seated nail is difficult to grasp with a claw portion of a hammer for removal. Installation has other difficulties, such as the installer having to hold the hanger bar while positioning the hanger bar and inserting the nail through the opening, and holding the nail (and the hanger bar) during nailing.

Accordingly, there is a need in the art for a hanger bar that that initially attaches to a support with a pre-A positioned and held fastener and subsequently can be adjusted positionally relative to the support before final attachment. It is to such that the present invention is directed.

BRIEF SUMMARY OF THE INVENTION

The present invention meets the needs in the art by providing a hanger bar that attaches between a pair of joists for supporting a fixture, comprising an elongate bar having an attaching plate at each opposing distal end. Each of the attaching plates has a contact portion for bearing against a side surface of a respective joist and a laterally extended portion that defines a recess relative to the contact portion. The extended portion defines an elongate slot that receives a bushing. A fastener extends through the bushing for engaging the joist to fix the elongate bar thereto. After initial attachment of the hanger bar to the joist by the fastener partially engaged to the joist, the hanger bar is selectively positionable relative to the joist by moving the attaching plate relative to the bushing in the elongate slot.

In another aspect, the present invention provides a method of attaching a hanger bar between a pair of joists for supporting a fixture therefrom, comprising the steps of:

(a) driving a fastener partially into a side face of joist, the fastener held by a bushing in an elongate slot having a plurality of arcuate recesses, the slot defined in an attaching plate at an end of a hanger bar;

(b) adjusting the position of the hanger bar relative to the joist by moving the hanger bar in a first direction or an opposing second direction in order to reposition the attaching plate relative to the busing, so that the attaching plate moves relative to the bushing in the elongate slot to reposition the bushing in another of the recesses therein; and (c) seating the fastener in the side faced of the joist.

Features, objects, and advantages of the present invention will be apparent upon reading the following detailed description in conjunction with the claims and the appended drawings.

DETAILED DESCRIPTION

Figure 1:
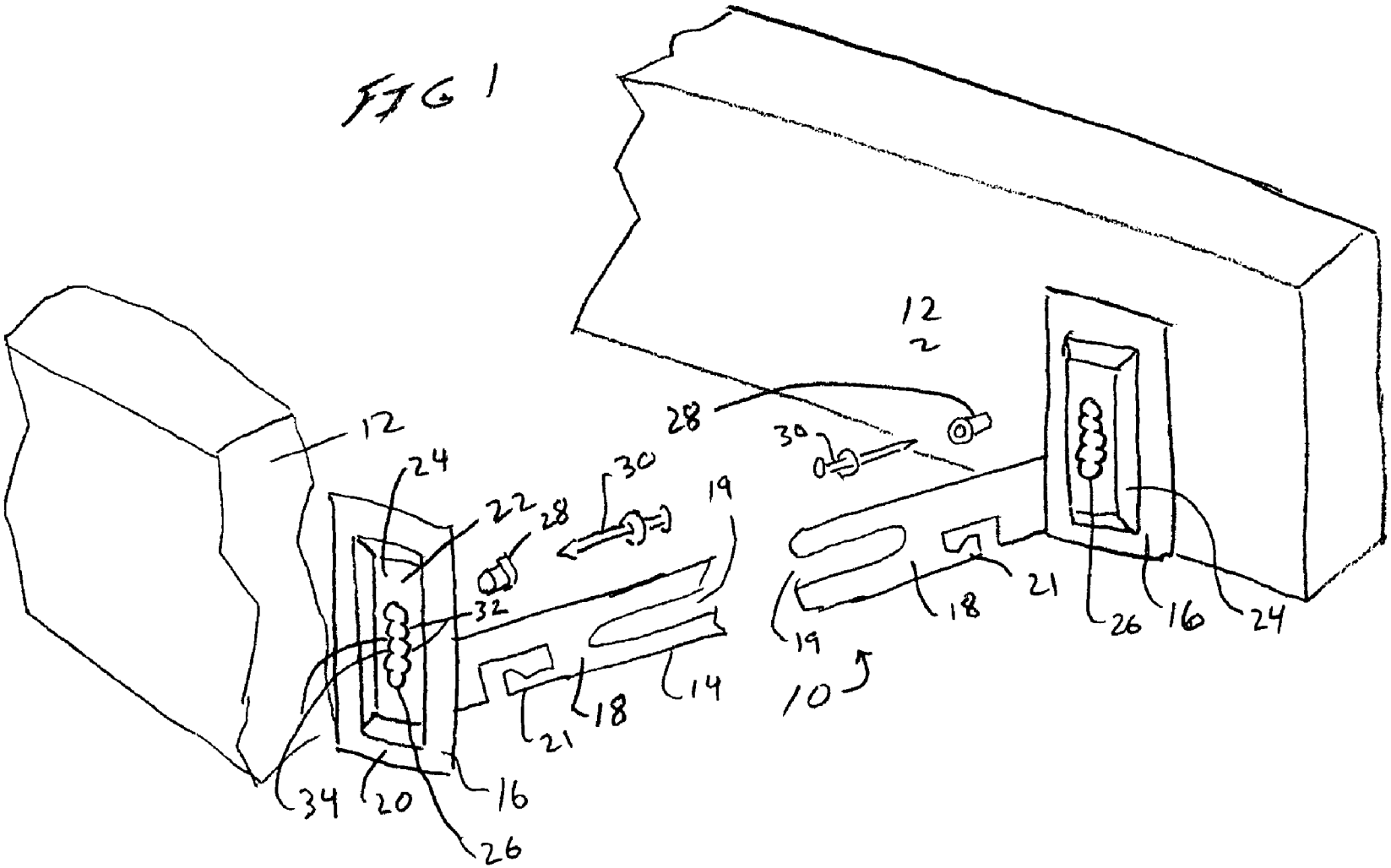
FIG. 1 is perspective view of a hanger bar for supporting fixtures between ceiling joists according to the present invention.

Referring now in more detail to the drawings, in which like numerals indicate like parts throughout the several views, FIG. 1 illustrates in perspective view a hanger bar 10 for supporting fixtures between ceiling joists 12 according to the present invention. The hanger bar 10 comprises an elongate bar 14 having an attaching plate 16 at each opposing distal end. In the illustrated embodiment, the elongate bar 14 includes separate members 18 that telescope together to form the elongate bar 14 capable of retracting and extending to facilitate mounting the hanger bar 10 to the joists, as is conventional. The members 18 define slots 19 that conventionally receive a guide extending from a fixture pan or facilitate attaching a bracket for supporting a fixture from the hanger bar 10. The members 18 further include a hook 21 for supporting an article from the hanger bar 10.

Each of the attaching plates 16 has a contact portion 20 for bearing against a side surface of a respective joist and a laterally extended portion 22 that defines a recess 24 relative to the contact portion. The extended portion 22 defines an elongate slot 26 that receives a bushing 28. A fastener 30, such as a nail or other securing member, extends through the bushing 28 for engaging the joist 12 in order to attach the hanger bar 10 to the joist (or other support surface). The bushing 28 is resilient or plastic, and defines a through bore that receives the fastener 30. The recess 24 provides a cavity for the bushing 28 and the tip of the fastener 30. The bushing 28 accordingly holds the fastener 30 pre-installed during manufacturing of the hanger bar 10 to facilitate installation at a particular job site, as discussed below.

The elongate slot 26 in the illustrated embodiment defines a plurality of acuate seats 32. The slot 26 includes narrowed portions 34 between adjacent seats 32. The bushing 28 is slidably received in a respective one of the arcuate seats 32. The bushing 28 is movable longitudinally along the slot 26 to occupy a selected one of the seats 32. The bushing 28 slightly compresses while passing relative to the narrowed portions 34, as discussed below.

Figure 2:
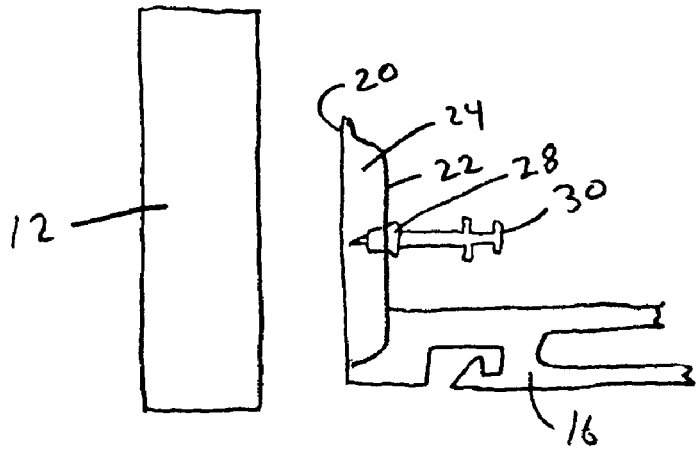
FIG. 2 is a side detailed view of the hanger bar illustrated in FIG. 1 for attachment to a ceiling joist.
Figure 3:
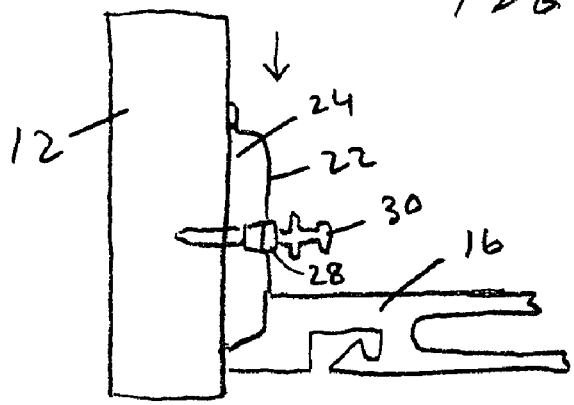
FIG. 3 is a side detailed view of the hanger bar illustrated in FIG. 1 initially attached to the ceiling joist.
Figure 4:
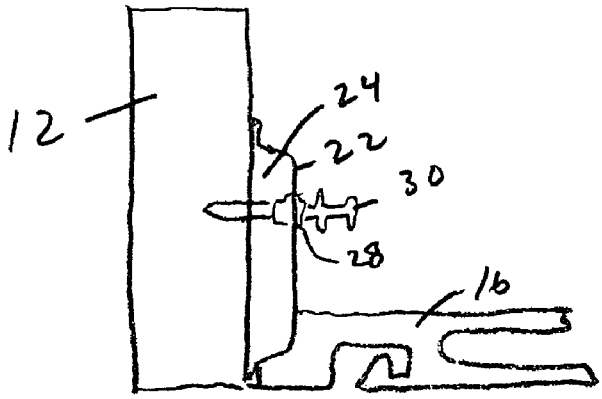
FIG. 4 is a side detailed view of the hanger bar illustrated in FIG. 1 repositioned after initial attachment to the ceiling joist.

FIGS. 2-4 are side detailed views of the hanger bar 10 during attachment to the ceiling joist 12. FIG. 2 is an exploded view of the hanger bar 10 prior to attachment to the ceiling joist. FIG. 3 illustrates the initial attachment of the hanger bar to the ceiling joist. FIG. 4 illustrates the hanger bar repositioned after initial attachment to the ceiling joist.

Figure 5:
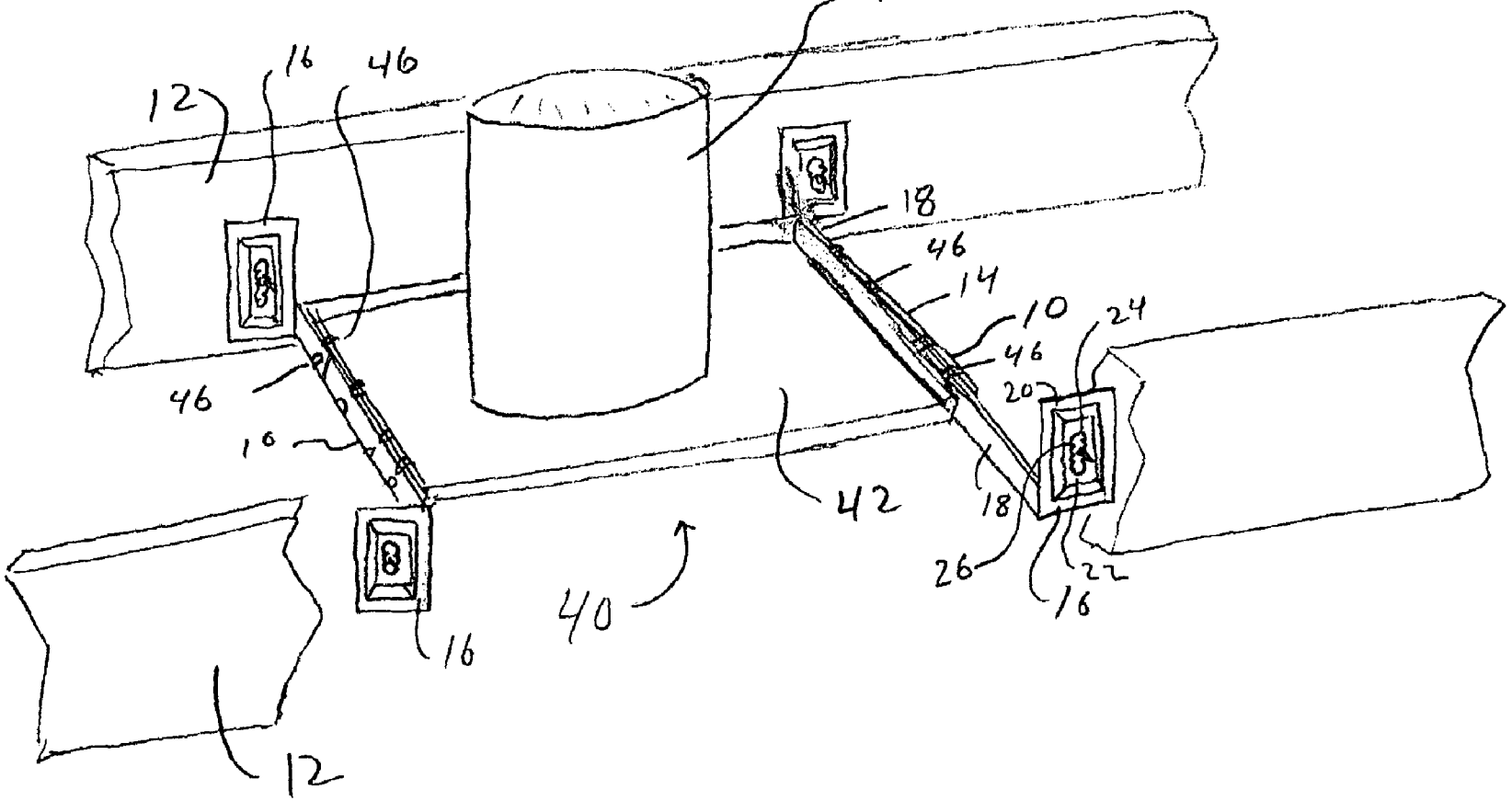
FIG. 5 is a perspective view of a recessed lighting fixture having a pair of the hanger bars according to the present invention.

FIG. 5 illustrates in perspective view a recessed lighting fixture 40 having a pair of the hanger bars 10 according to the present invention. The recessed lighting fixture 40 includes a pan 42 that supports a lighting cylinder 44. The lighting cylinder 44 houses a light socket and lamp (not illustrated) connectable through an electrical cord to a supply of electrical current. Such pan, lighting cylinder, light socket, and lamp are conventional and are not otherwise discussed. The pan 42 includes conventional spaced-apart pairs of L-shaped flanges 46 that define channels for receiving the members 18 of the hanger bar 10 on opposing sides of the pan.

With reference to FIGS. 1 and 2, the hanger bar 10 attaches to ceiling joists 12 by aligning the attaching plates 16 with the opposing sides of the joists. The contact portion 20 bears against the side of the respective joist. The bushing 28 holds the pre-installed fastener 30 in the recess 26 for installation. With reference to FIG. 3, the fastener 30 is partially driven into the joist to attach the hanger bar 10 between the joists. The hanger bar 10 is the aligned relative to a lower edge of the joist 12 so that the hanger bar is substantially horizontal between the joists. This is accomplished by moving the attaching plate 16 upwardly or downwardly relative to the bottom edge of the joist, such as by tapping a hammer on an lower or upper surface of the attaching plate. With reference to FIG. 4, the fastener 30 holds the hanger bar 10 as initially installed. However, during the tapping, the slot 26 guides the movement of the attaching plate 16 as the narrowed portion 34 passes by the bushing 28 (initially positioned in one of the seats 32) and is received in the adjacent seat. The bushing 28 compresses and the narrowed portion 34 moves past the bushing and the bushing is then received in the adjacent seat.

Accordingly, with reference to FIGS. 2-4, after initial attachment of the hanger bar 10 to the joist 12 by the pre-positioned fastener 30 partially engaging to the joist, the hanger bar is then selectively positionable relative to the joist by moving the attaching plate relative to the bushing in the elongate slot.

The present invention accordingly provides the hanger bar with pre-installed fasteners for readily installing the hanger bar to joists for supporting fixtures. The hanger bar is readily and gainfully employed with recessed lighting fixtures as illustrated in FIG. 5 and with conventional brackets and attachers that engage the elongate bar 14 for holding lighting and other fixture devices. The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. A hanger bar attachable between a pair of joists for supporting a fixture therefrom, comprising:

an elongate bar having an attaching plate at each opposing distal end;

each of the attaching plates having a contact portion for bearing against a side surface of a respective joist and a laterally extended portion that defines a recess relative to the contact portion;

the extended portion defining an elongate slot;

a bushing received in the elongate slot; and a fastener extending through the bushing for engaging the joint to fix the elongate bar thereto, whereby the hanger bar is thereafter selectively positionable relative to the joist by moving the attaching plate relative to the bushing in the elongate slot.

2. The hanger bar as recited in claim 1, wherein the slot defines a plurality of arcuate seats each separated from an adjacent seat by a narrowed portion of the slot, and the bushing slidably received in a respective one of the arcuate seats while moving the attaching plate to position the hanger bar relative to the joint.

3. The hanger bar as recited in claim 1, wherein the elongate bar is telescopically extendable from a first position to a second position.

4. The hanger bar as recited in claim 3, wherein the elongate bar includes a pair of matingly engaged members that slidingly move relative to each other between the first position and the second position.

5. The hanger bar as recited in claim 1, wherein the fastener comprises a nail.

6. The hanger bar as recited in claim 1, wherein the contact portion comprises a perimeter edge of the attaching plate.

7. The hanger bar as recited in claim 6, wherein the extended portion comprises a planar portion connected to the perimeter edge by angled portions.

8. The hanger bar as recited in claim 1, wherein the bushing is resilient for flexibly moving past narrowed portions from a first one of a plurality of arcuate seats to an adjacent one of the arcuate seats.

9. The hanger bar as recited in claim 1, further comprising a bracket for connecting an electrical fixture.

10. The hanger bar as recited in claim 1, further comprising an electrical fixture attached thereof for disposing between adjacent joists.

11. A hanger bar attachable between a pair of joists for supporting a fixture therefrom, comprising:

an elongate bar having opposing distal ends each with an attaching plate thereat;

each of the attaching plates having a perimeter contact portion for bearing against a side surface of a respective joist and a dished portion recessed relative to the contact portion, the dished portion defining an elongate slot having a plurality of arcuate seats each separated from an adjacent seat by a narrowed portion of the slot;

a pair of resilient bushings having a through bore therein and each received in a respective slot; and a pair of fasteners each extending through a respective one of the bushings for engaging a joist to secure the elongate bar thereto, whereby the hanger bar, being initially attached to the joists by partially seating the fasteners in the respective joists, is thereafter selectively positionable relative to the joist by moving the attaching plates relative to the bushings in the elongate slots to move the bushings between first and second arcuate seats.

12. The hanger bar as recited in claim 11, wherein the elongate bar is telescopically extendable from a first position to a second position.

13. The hanger bar as recited in claim 12, wherein the elongate bar includes a pair of matingly engaged members that slidingly move relative to each other between the first position and the second position.

14. The hanger bar as recited in claim 11, wherein the fastener comprises a nail.

15. The hanger bar as recited in claim 11, wherein the contact portion comprises a perimeter edge of the attaching plate.

16. The hanger bar as recited in claim 15, wherein the extended portion comprises a planar portion connected to the perimeter edge by angled portions.

17. The hanger bar as recited in claim 11, wherein the bushing is resilient for flexibly moving past one of the narrowed portions from a first one of the plurality of arcuate seats to an adjacent one of the arcuate seats.

18. The hanger bar as recited in claim 11, further comprising a bracket for connecting an electrical fixture.

19. The hanger bar as recited in claim 11, further comprising an electrical fixture attached thereof for disposing between adjacent joists.

20. In a fixture adapted for mounting to a support structure, the improvement comprising:

attachment means associated with the fixture for attachment to the support structure, the attachment means being capable of temporary attachment to the support structure; and adjustment means carried by the attachment means for adjusting the position of the attachment means and thus the fixture relative to the support structure after temporary attachment thereto and prior to a relatively more permanent attachment of the attachment means to the support structure, wherein the fixture is a downlighting fixture mountable to a support structure comprising at least one moist associated with a ceiling having an opening through which light emanating from the fixture passes into an environmental space for illumination thereof, at least one bar hanger assembly being carried by the fixture, the attachment means comprising at least one attachment plate disposed on the bar hanger assembly, a bridge element joined to the attachment plate and extending above an outwardly facing surface of the attachment plate, the bridge element having a substantially planar face portion within which a slot is formed, the attachment means further comprising fastener means received within the slot and carried by the attachment plate, a portion of the attachment means being capable of an initial temporary attachment to the joist, wherein the fastener means comprises a fastener received within the slot, the adjustment means being carried by the fastener and acting to maintain the fastener in a predetermined location within the slot, wherein the adjustment means comprise bushing means carried by the fastener and slidable thereon for reception within the slot and for frictional engagement with peripheral portions of the attachment plate defining the slot sufficient to maintain the bushing means and associated fastener within the slot on absence of an imposed force sufficient to move the bushing means and associated fastener to another location of the slot.

21. In the fixture of claim 20 wherein the fastener comprises a nail and the bushing means comprise a bushing having a channel therethrough within which the nail is received, the bushing having a dimension slightly less than the dimension of at least opposed portions of the peripheral portions of the plate defining the slot to allow forceable displacement of the bushing within the slot to differing locations of the slot.

22. In the fixture of claim 21 wherein the bushing is formed of a relatively rigid material having a degree of resiliency enabling slight deformation between said opposed portions of the peripheral portions of the plate defining the slot to allow forceable displacement of the bushing within the slot to differing locations of the slot.

23. In the fixture of claim 22 wherein the slot formed in the attachment plate is shaped in a longitudinally-extending series of intersecting partially circular arcs to define a series of seating spaces having diametric dimensions permitting a body portion of the bushing to fit substantially flushly therewithin and to thereby define a series of locations within which the bushing can be positioned to maintain the bushing and the associated nail in place on the plate.

24. In the fixture of claim 23 wherein the nail is adapted to be driven through the channel in the bushing partially of its length into the joist to initially tack the attachment plate to the joist.

25. In the fixture of claim 24 wherein the nail is a double headed nail having a first head disposed at one end opposite a point formed on the opposite end thereof, a second head being spaced inwardly along the nail in spaced relation to the first head, the second head being displaced on driving of the nail into the joist against a portion of the bushing disposed outwardly of the plate to at least temporarily secure the bushing and associated nail within the slot, thereby to at least temporarily mount the fixture in affixed relation to the joist.

26. In the fixture of claim 25 wherein the attachment plate further comprises contact portions disposed relative to the slot formed in the plate, the contact portions being adapted to have a force exerted thereagainst to displace the plate relative to the bushing and the associated nail, thereby to adjust the position of the plate relative to the bushing and thus relative to the joist.

27. In the fixture of claim 20 wherein the fixture comprises an electrical fixture.

28. In the fixture of claim 20 wherein the fixture comprises an electrical ceiling fan.

29. In the fixture of claim 20 wherein the fixture comprises an electrical junction box.

30. In the fixture of claim 20 wherein the bar hanger assembly is comprised of rail elements mounted to and slidably movable relative to each other to adjust the length of the assembly, each rail element having attachment means carried thereby.

* * * * *